United States Patent [19]

Hoffmann et al.

[11] 4,432,111

[45] * Feb. 21, 1984

[54] PROCEDURE FOR WASHING CLOTHES

[75] Inventors: Ernst H. Hoffmann, Dortmund; Hans F. Arendt, Sersheim, both of Fed. Rep. of Germany

[73] Assignee: Estel-Hoesch Werke Aktiengesellschaft, Fed. Rep. of Germany

[ * ] Notice: The portion of the term of this patent subsequent to Aug. 17, 1999 has been disclaimed.

[21] Appl. No.: 278,108

[22] Filed: Jun. 29, 1981

Related U.S. Application Data

[63] Continuation-in-part of Ser. No. 149,116, May 12, 1980, Pat. No. 4,344,198.

[30] Foreign Application Priority Data

Jun. 28, 1980 [DE] Fed. Rep. of Germany ..... 3024571
Nov. 8, 1980 [DE] Fed. Rep. of Germany ..... 3042198

[51] Int. Cl.[3] ..... D06F 23/02
[52] U.S. Cl. ..... 8/158; 8/159; 68/24; 68/58
[58] Field of Search ..... 8/158, 159, 137; 68/24, 68/58, 210

[56] References Cited

U.S. PATENT DOCUMENTS

| | | | |
|---|---|---|---|
| 2,556,490 | 6/1951 | Chamberlin | 8/159 |
| 2,615,320 | 10/1952 | Belaieff | 68/24 |
| 3,387,310 | 6/1968 | Marshall | 8/158 |

FOREIGN PATENT DOCUMENTS

| | | |
|---|---|---|
| 660134 | 5/1938 | Fed. Rep. of Germany . |
| 843688 | 7/1952 | Fed. Rep. of Germany . |
| 867235 | 2/1953 | Fed. Rep. of Germany . |
| 1681121 | 8/1954 | Fed. Rep. of Germany . |
| 1205936 | 6/1966 | Fed. Rep. of Germany . |
| 1610313 | 5/1967 | Fed. Rep. of Germany . |
| 1953201 | 4/1970 | Fed. Rep. of Germany . |
| 1410970 | 4/1973 | Fed. Rep. of Germany . |
| 2840241 | 9/1978 | Fed. Rep. of Germany . |
| 1408823 | 7/1965 | France . |

OTHER PUBLICATIONS

Book entitled "Die Wascherei", by Dr. W. Kind and Dr. H. A. Kind published by Konradin Verlag, Stuttgart, 2nd Ed., 1956, pp. 218–219.
Journal entitled "Reiniger and Wasche", No. 5, 1971, pp. 26–30.

*Primary Examiner*—Philip R. Coe
*Attorney, Agent, or Firm*—Burton, Parker & Schramm

[57] ABSTRACT

The invention concerns a procedure and a mechanism for washing textiles in a tub-type washing machine with a horizontally arranged tub, in which during the washing and rinsing cycles the tub is driven with a rotational velocity at which the centrifugal velocity at the tub case is between 0.4 and 0.95 g, so that the textiles are repeatedly lifted up, and then fall in a trajectory onto the lower portion of the tub, and that between the washing and rinsing cycles and after the last rinsing cycle the tub is driven at spin speed, and in which the washing or rinsing liquid is led into the suds container and is supplied to the textiles by immersing the tub in the liquid or by at least one spray nozzle spraying into the tub continuously or at intervals.

14 Claims, 4 Drawing Figures

PROCEDURE FOR WASHING CLOTHES

CROSS-REFERENCE TO RELATED APPLICATIONS

This application is a continuation-in-part of United States Ser. No. 149,116 filed May 12, 1980, and now U.S. Pat. No. 4,344,198.

The invention concerns a procedure for washing textiles in a tub-type washing machine with a horizontally arranged tub, in which during the washing and rinsing cycles the tub is driven with a rotational velocity at which the centrifugal velocity at the tub case is between 0.4 and 0.95 g, so that the textiles are repeatedly lifted up, and then fall in a trajectory onto the lower portion of the tub, and that between the washing and rinsing cycles and after the last rinsing cycle the tub is driven at spin speed, and in which the washing or rinsing liquid is led into the suds container and is supplied to the textiles by immersing the tub in the liquid or by at least one spray nozzle spraying into the tub continuously or at intervals.

One such procedure is known, for example, in Patent DE-PS No. 867235. In that case washing is done at a liquid level in the tub equalling 22–30% of the tub diameter, with water and detergents supplied separately. The washing cycle is followed by several rinsing cycles and a subsequent spin cycle. A soaking period may also be provided. The transition from a rinsing cycle to the spin cycle takes place with as little imbalance as possible by a gradual increase of the speed.

That procedure has the disadvantage that because of the initially uneven concentration of the washing liquid, the textiles, at least partly, first only absorb water which as a rule is not even removed during spinning from the mesh of the fabric and from the spaces between individual fibres. To enrich this water with a sufficient amount of detergent in areas where dirt has accumulated requires a considerable amount of kinetic energy.

When the used washing liquid is removed, the same problems occur. To free the textiles of suds requires considerable amounts of water.

It is the object of the invention to demonstrate a washing procedure in which a washing liquid of required concentration is brought with certainty into the mesh of the fabric and is for the most part removed again, considerably reducing the water requirement, and to create a tub-type washing machine for the implementation of the procedure.

According to the invention this is accomplished in such a way that when the machine is loaded, the tub rotates at a velocity at which the centrifugal velocity at the tub case is 0.2–0.6 g, and that washing liquid is constantly added until all textiles are equally wetted with a quantity of washing liquid that equals 45–100% of the maximum amount which the textiles can absorb, that subsequently to the washing cycle the tub is driven at a certain spin speed until after the complete discharge of a first quantity of washing liquid a second amount of liquid flowing out again is spun out, that during the following rinsing cycle water is added in the same manner as liquid is added for washing, and that the tub is driven at the same speed as for washing, that prior to each subsequent rinsing cycle spinning is done in the same way as after washing.

According to a preferred embodiment of the procedure according to the invention, washing liquid and rinsing water is filled into the suds container in such a manner that the textile pieces lying at the bottom of the tub at that moment are on the average immersed less than 30%. A very good washing result can also be achieved by driving the drum during the spin cycle until about 85% of the liquid absorbed by the textiles minus the liquid soaked up by the fibres is spun out. Spinning after the last rinsing cycle can be done in such a way that at least 90% of the water absorbed during the last rinsing cycle minus the the liquid soaked up by the fibres is removed. To limit absorption of soaked-up liquid it is recommended that the tub is driven for less than 3 minutes when the machine is loaded, for a maximum of 6 minutes during washing and for a maximum of 4 minutes during each rinsing cycle.

It is also recommended that in washing liquid added to the textiles the detergents are only 95% dissolved, and that the differences in concentration of the washing liquid are less than 10%. The washing liquid in this case can be a saturated detergent solution. Preferably the washing liquid and the rinsing water are used as temperatures which are the maximum tolerable for each type of textiles. Furthermore the temperature of the liquid in the tub can be maintained by adding heat energy. According to another suggestion in terms of the invention, after spinning, except after the final dry-spinning, the textiles are pressed away from the tub case by a stream of water directed into the tub from outside through holes of the tub. It is practical that initially 70–80% of the liquid is added to the textiles, and that the rest is added after an interval of at least 20 seconds.

The tub-type washing machine for implementing the procedure with a tub arranged in a housing and driven at various rotational velocities, with a control device for liquid inflow and a device for gradually increasing the rotational velocity of the tub during the transition from the washing to the spin cycle is characterized in that the control device for the liquid inflow is designed in such a way that the textiles are moistened only to about 45–100% of their total absorbing power.

The control device for the liquid inflow can consist of a lower intake and a water level control arranged at such a level that after absorbing the liquid flowing into the tub whose level during the washing or rinsing cycle is tangent to the tub bottom, so that the amount of liquid constantly emitted by the textiles is approximately equal to the amount flowing into the tub.

The control device for the liquid inflow can also consist of at least one spray nozzle and a measuring device governing the spray nozzle for measuring the amount of liquid running off the textiles.

According to another characteristic of the invention, a flow indicator is provided in the outflow line of the machine, coupled with a program control circuit in such a way that during the spin cycle after the initially spun-out liquid has flown off, the spin speed is again increased until liquid is once more discharged.

It is practical to design the tub without carrying-vanes.

According to another practical embodiment, the tub drive is non-reversing.

For use in assembly-line service, the machine is preferably designed as a pass-through tub with loading and unloading ports at opposite ends of the tub.

In this case, it is practical to design the loading port as a conically widening tube forming a hollow shaft for unilateral tub mounting.

Another characteristic of the machine is that it has a space between tub and housing that narrows in the direction in which the tub rotates. This narrowing can be accomplished by the excentric arrangement of the tub in a cylindrical housing, preferably with the maximum of narrowing in the direction of tub rotation behind the highest point of the tub. Furthermore, a water inflow can be provided in the area of the opening of the narrowing. According to another suggestion of the invention, the machine is provided with an unbalance control connected to an off-switch of the motor.

In another design according to the invention it is suggested that the front surfaces of the tub have the shape of the rotational surface of a catenary about the major axis of inertia, preferably with the curvature of the front surfaces being about 1/6 as high as the diameter of the tub.

Furthermore the front surfaces of the tub can be connected by a cylindrical centre part whose width is about equal to ¼ of the height of the curvature of the front surfaces. Only the cylindrical centre part can have perforations.

The procedure according to the invention is based on the fact that the difficulties in the mixing of liquids having different specific weights increase considerably under the influence of capillary action and require the use of large amounts of kinetic energy.

Textile structures have three different capillary spaces: first of all the mesh of the fabric and outer open gaps between the fibres of the fabric's filaments, secondly the spaces between fibres inside the filaments, and thirdly the capillaries of the fibres themselves into which liquid can penetrate causing them to swell.

When textiles are washed, the liquid is mainly exchanged on the surface and between creases of the textiles. However, since dirt also penetrates into the first two capillary spaces mentioned above and occasionally also into those of the second type, the above mentioned difficulties result.

On the other hand, it is known that textiles except for example impregnated or particularly tightly-woven pieces, such as rugs, absorb within a very short time up to 200 or 300% of their weight in liquid. If it is possible to remove liquid from the first-named capillary space and to replace it with new liquid, mixing and diffusion processes are largely unnecessary.

It was found that under normal conditions prevailing in a spin-type machine, only free liquid and liquid in the creases of the textiles can be removed. In order to extract a considerable proportion of the liquid contained in the first-named capillary spaces, much higher spin speeds are required, which, however, can be reduced by lowering the surface tension of the liquid, for example, by adding detergents and by using higher temperatures.

Thus the following consequences result for washing procedures:

1. The first-named capillary spaces must be occupied by washing liquid from the start; using a homogenous suds solution, the entire amount of detergent must be added.
2. After the washing cycle a spin cycle is essential.
3. For the rinsing cycles, the water temperature must be approximately the same as for the washing cycle. Unless already contained in the washing medium, detergents must be added.
4. Free liquid is not required.
5. The water soaked up by the fibres does not participate in the washing process but must be carried along. Thus the washing cycle should be as short as possible.

Thus an optimal washing procedure according to the invention results when concentrated or even saturated suds are prepared which are then applied to the textiles in an amount that equals between 45 and 100% of their absorbing power.

Excellent washing results are achieved at only 60%, and these results cannot be improved by using more liquid. The quantity of this potentially absorbed liquid varies greatly from one type of fabric to another and can easily determined by means of tests. The procedure is not hampered by mixing different types of textiles in a load and if the mixing ratio fluctuates, because in any case when an average is achieved, a value between 45 and 100% is still maintained.

This can be done in two different ways. Enough washing liquid can be filled into the suds container to maintain a low liquid level in the tub. This level would be constantly absorbed by the textiles which are loaded gradually, until the desired degree of wetting is achieved. To even out the degree of wetting, the load must be moved simultaneously in the tub, but not so vigorously that some of the absorbed liquid flow out again. A tub speed at which the centrifugal velocity at the tub case is 0.2–0.6 g has been found practical.

The liquid level in the tub should be so high that the the pieces lying at the bottom of the tub at that moment are on the average immersed less than 30%, and the loading process should not take longer than 3 minutes.

The washing liquid can also be sprayed onto the full dry load in the tub by at least one spray nozzle that sprays either continuously or at intervals, while the tub is moved, and the maximum amount continuously sprayed in should be as much as is by and large absorbed by the textiles. Any liquid that may flow out must be replaced to allow the textiles to reach the required degree of wetting.

In the first case, no free liquid is in the tub after loading is completed, and in the second case, no free liquid is in the suds container either. Thus the amount of detergent necessary for cleaning must be contained in that portion of the liquid that is absorbed by the textiles. The liquid therefore consists of concentrated or even saturated detergent solution.

Loading of the tub is followed by a conventional washing cycle with a tub velocity at which the centrifugal velocity at the tub case is between 0.4 and 0.95 g. Unless this has happened already during loading, the process of wetting the textiles is now evened out, the dirt is dissolved, and the washing liquid in the capillaries is moved. But the washing process should not last longer than 6 minutes in order to limit the swelling of fibres. Furthermore, the highest permissible temperature for each type of textiles should be used. In view of the fact that there is little or no free liquid, this maximum temperature should be maintained by additional heating, for example, by blowing in hot steam. Since the procedure according to the invention may require high spin speeds up to 350 g, special care must be taken when the spin cycle starts that the load is evenly distributed and laid against the tub wall, to prevent an unbalance.

The spin speed depends on the textiles. It is easy to see that it must be considerably higher for heavy cotton goods than for example for loose polyester goods. Furthermore it depends on the temperature and on the detergent content of the liquid. It can be assumed that a sufficient degree of drainage is achieved when about 85% of the liquid absorbed by the textiles, minus the water soaked up by the fibres, is spun out. For the final spin, this amount can also be 90% or more. In practice, however, it requires a lot experience to determine the degree of draining visually. It is difficult and time consuming to measure this. However, since the free liquid and the surface water flows off even at a moderate spin speed, and since a much increased speed is required to remove the water from the mesh of the fabric, it can be observed that after the surface water has flown off, a smaller amount of water suddenly flows off again after an interval. This phenomenon can be observed also when spinning is done with the required high speed from the start. It is found that a certain minimum speed is necessary to spin on the liquid out of the mesh of the fabric. For removing the liquid from the gaps between the fibres inside the filaments another, higher critical speed is necessary, but it would be uneconomical to use this speed for the purpose at hand.

The subsequent rinsing cycles are analogous to the washing cycle, and the rinsing water is filled in the same manner as when the tub is loaded, although the load, of course, remains in the tub. The water should have about the same temperature as the washing liquid. Furthermore, because only up to 85% of the water absorbed by the textiles is removed, some of the detergents are carried over into the next cycle, so that it is not necessary to add any more. One rinsing cycle should not exceed 4 minutes.

Because of the high spin speed, the load forms a solid ring around the tub wall. This ring is difficult to separate from the tub wall. By applying pressurized liquid to at least a part of the tub case, for example by creating a blockage between tub case and suds container, the ring can be pressed away from the wall, and the tub can be at the same time slowed down. This measure can be deleted after the final spin cycle, although this is not absolutely necessary, since the re-moistening which occurs is limited when the process is interrupted in time.

The invention is explained in detail by means of the drawing, as follows.

Figures 1, 2:
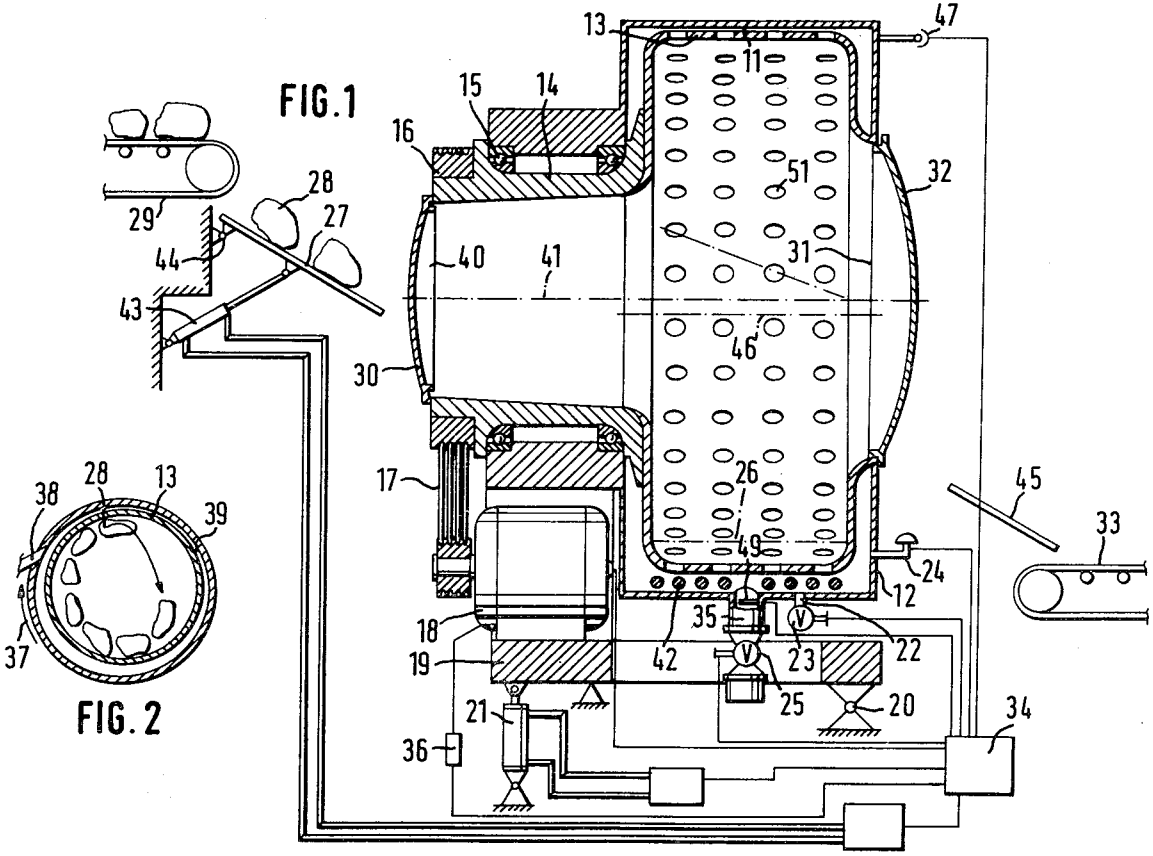
FIG. 1 shows a longitudinal section through an embodiment of the washing and spinning machine according to the invention.
FIG. 2 shows a cross section through the tub and housing of the machine according to FIG. 1.

The washing machine according to FIG. 1 consists of a housing 11 whose lower portion serves as container pan 12 for water or suds. Housing 11 contains a rotatable tub 13 that is perforated at the case surface. This tub 13 is provided on one side with a conical hollow shaft 14 whose smallest diameter is on the outside of the machine. Between hollow shaft 14 and the housing are bearings 15 in which the tub 13 is mounted unilaterally. Hollow shaft 14 and thus also tub 13 are driven by drive motor 18 via belt pulley 16 and belt 17. Motor 18 is rigidly connected to housing 11 of the washing machine via drive console 19. The entire washing machine can be slightly tilted about fulcrum 20. Tilting is accomplished by drive 21 which, for example, could be hydraulic, pneumatic or electric. Water is fed to container pan 12 of housing 11 through intake 22. The suds are kept exactly at the required level 26 by means of magnetic valve 23 connected with water level control 24. The wash suds are led into the container pan 12 of the housing 11 in a similar manner through a hose (not shown). Rinse water and wash suds run off through discharge valve 25 as soon as they are no longer required. Textile pieces 28 are conveyed fully automatically and separately into tub 13 by means of feeding conveyor 29 and chute 27. The chute can be tilted toward loading port 40 about joint 43, by means of drive 43.

When the textiles are loaded into the machine, only cover 30 is open (if it is provided), while cover 32 of unloading port 31 remains closed.

The machine is provided with program control circuit 34 which is suitably connected with the control and regulating elements of the machine. It is also provided with a device for gradually increasing the rotational velocity of the tub during the transition from the washing cycle to the spin cycle, such as a barrier resistor 36 in the circuits of motor 18. On the unloading side, the machine has a chute 45 and a removal conveyor, such as a conveyor belt, 33.

In outflow line 35 of tub 13, a flow indicator 49 is provided which gives a signal to program control circuit 34 when liquid flows out.

Furthermore, the machine can be provided with a heating aggregate with heating pipes 42 and an unbalance control 47. Tub 13 is arranged excentrically in housing 11. The housing axis 46 is placed parallel to the axis of rotation 41 of tub 13, so that the space between tub and housing has a narrowing in its upper portion. The maximum 39 of this narrowing in rotational direction 37 of the tub lies behind the highest point of the tub. At the opening of the narrowing a water inflow 38 is provided which preferably opens tangentially into the space.

Figures 3, 4:
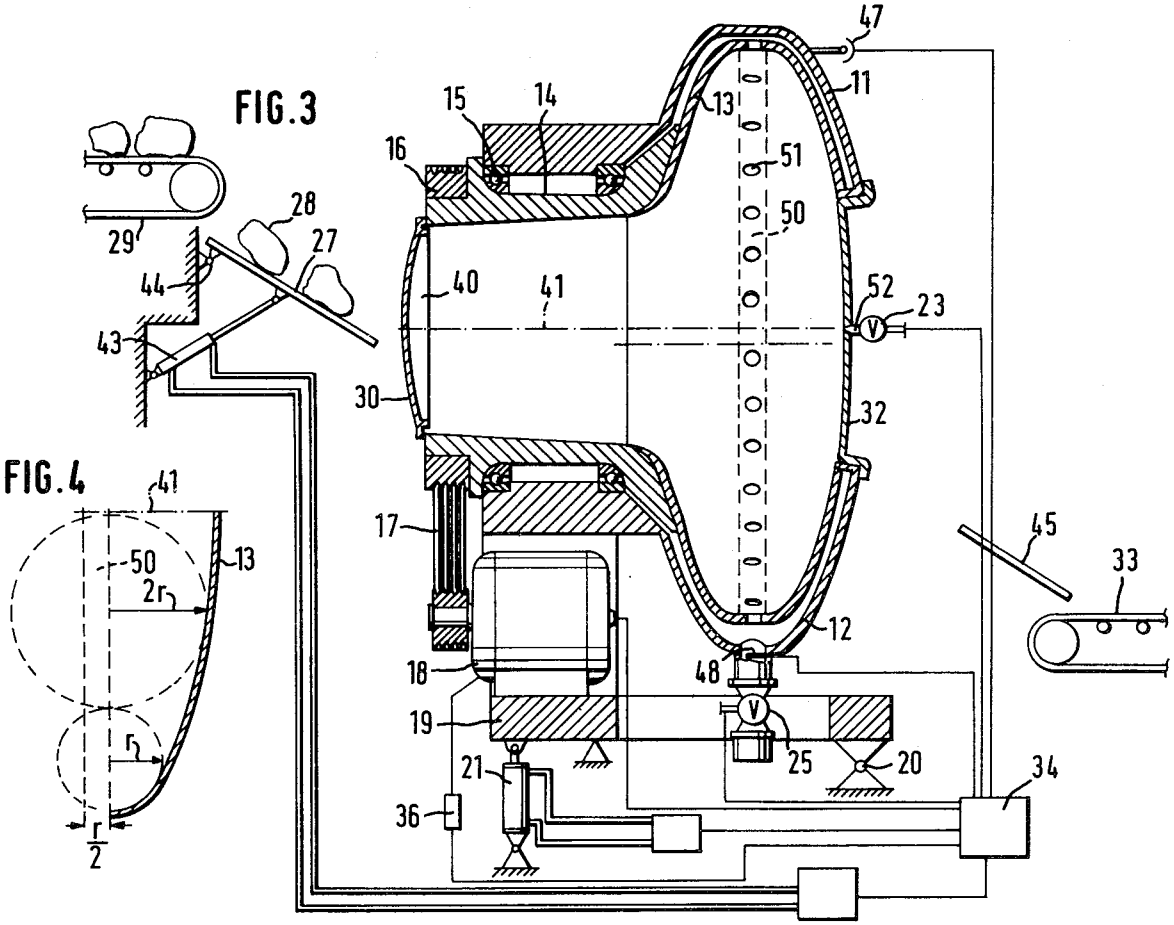
FIG. 3 shows a further embodiment of the machine.
FIG. 4 shows the tub design according to FIG. 3.

The machine according to FIG. 3 differs in that the liquid inflow is designed as spray nozzle 52 and arranged in cover 32, and that in outflow line 35 there is not only a flow condition but also a measuring device 48 for the liquid that runs off from the textiles. This measuring device 48 can be combined with the flow indicator or can be a specially designed version of flow indicator 49.

The front surfaces of this tub have the form of the rotational surface of a catenary about axis 41. Between the front surfaces is a cylindrical centre part 50 which alone is provided with perforations 51. A practical type of construction is a version where the height of the curvature of the front surfaces is about 1/6 of the tub diameter, and where the width of the cylindrical centre part is about ¼ of the curvature height of the front surfaces.

As mentioned above, the machine is meant to be used for a new washing procedure in which the amount of "engaged" liquid is lower than the maximum amount that can be normally absorbed by the textiles. For dissolving the dirt it is sufficient to apply the liquid in the area close to the fibres and to the mesh of the fabric. In practice, the amount of liquid applied will be greater than required, if for no other reason than that some of the water is absorbed by the fibres and no longer participates in the rest of the process.

For that reason, water level control 24 has been arranged at such a level that only an amount of liquid remains in the tub that can be constantly absorbed by the textiles. To achieve even wetting, the textiles are loaded separately while the tub is moving at a speed at which the centrifugal velocity at the tub case is about 0.3 to 0.8 g. During the washing process, at a tub speed of 0.4 to 0.95 g, a liquid level results in the housing that is approximately tangent to the tub bottom, so that the small amount of liquid emitted by the textiles when they fall onto the tub wall is approximately equal to the amount flowing into the tub. In practice, the liquid level touches the tub on one surface, since some of the liquid is carried along the tub case by the tub movement.

In the embodiment according to FIG. 3 the textiles are wetted by spray nozzle 52 directed into the tub. It must be noted that in the case of a small load the textiles may sometimes not absorb the entire measured amount of liquid, but that the liquid may run off into pan 12. Since the washing should be done without free liquid in this case, the liquid intake must be cut back, or the outflowing amount of liquid must be measured, and an appropriate additional amount of liquid must be brought in by spray nozzle 52. This is accomplished by means of measuring device 48 which controls spray nozzle 52 by means of program circuit 34 and valve 23.

For achieving the required spin speed it is essential that the textiles are pressed to the tub diameter in a very accurate manner to prevent the occurrence of even a small unbalance. This means that the transition from washing speed to spin speed must be slowed down. This can be accomplished, for example, by means of barrier resistor 36. After the textiles are pressed to the tub, the rotational speed can be increased again.

It can be recognized that the necessary spin speed has been reached when after the outflow of the liquid that is emitted at the beginning of the spin cycle liquid discharge stops to continue only with a surge when the speed increases. No further increase of the spin speed is necessary at that point. This point can be recognized, for example, by means of flow indicator 49 which can either be installed in outflow line 35 in addition to measuring device 48, or which can be combined with the measuring device into a single instrument. Thus, for example, the flow indicator can be a flap inserted in outflow line 35, preferably having a diameter smaller than the inside cross section of the line and having a floater at its free end. In its resting position this flap can, for example, be held by a spring force which must be overcome to turn it from this position upward or downward. When an amount of liquid collects in the part of the outflow line above valve 25, the flap is lifted up. Liquid flowing out presses it down. From these movements appropriate signals can be derived and transmitted to program circuit 34.

After spinning, the textiles are easier to detach from the tub wall when the space between tub 13 and housing 11 is designed in such a way that it narrows in rotational direction, preferably in the upper portion of the housing. This can be achieved through appropriate additions, but also by excentric suspension of the tub. The narrowest point 39 of the space in rotational direction should lie behind the highest point of the tub. At the opening of this narrowing a water inlet 38 can be provided which preferably ends tangentially in the space, in direction of the narrowing. After completion of the spin cycle a blockage can quickly be achieved through water intake, through which the textiles are pressed away, and the tub is slowed down. The arrangement should be made in such a way that the water flown in is not more than the amount of water required for the rinsing cycle analogous to the washing cycle. Since the amount of water required for the rinsing cycle is not greater, but because of the water absorbed by the fibres and because of liquid remnants it is more likely greater than the amount of water required for the washing cycle, the water level or the amount of rinsing water to be added does not require changing, except that the amount o water added by water inflow 38 must be taken into account. For types of textiles that cannot be washed in hot water, a high tub speed cannot be avoided, at least not in the final spin cycle. The textiles must therefore be placed very evenly along the tub wall. For this a tub design without carrying vanes is practical. The fact that the textiles are still carried along by the tub wall during the wash cycle and do not slide back after slight lifting, is due to the low level or complete absence of liquid in the tub. Reversing the tub is not necessary for the procedure described, and this would only disturb and lengthen the washing and rinsing cycles.

The textiles are pressed particularly accurately to the tub wall when the tub has the shape of a rotational body of a catenary about the major axis of inertia. In this case a cylindrical centre part can be provided in the area of the plane of symmetry transverse to the tub axis. The curved frontal surfaces of the tub are adjacent to this centre part. The catenary in this case is enclosing two touching circles with a radius ratio of 1:2, and the width of the cylindrical centre part is approximately equal to the half radius of the smaller circle (FIG. 4). Preferably perforations 51 are provided only in the cylindrical centre part 50, but in any case only in the area of the largest tub diameter.

Surprisingly this results in an optimal utilization of kinetic energy in the washing and rinsing cycles and in a particularly even adherence of the textiles to the tub wall.

Since the amount of liquid used is small, additional heat may have to be provided, particularly during the washing cycle. This can be done, for example, by steam pipes 42 installed in the housing. If no free liquid is present, other measures are required, such as blowing in steam or hot air, etc.

The machine's program circuit 34 must be designed according to the particular procedure used; in particular it must provide for a spin cycle directly following the washing cycle.

The textiles are laid against the tub case so evenly that the tub or the housing do not require a spring suspension and that unbalance control 47 merely serves as a safety measure.

According to the procedure of the invention, this machine can achieve surprisingly good cleaning results when washing such items as badly soiled industrial cotton goods whose average soil content is 15%. This is accomplished with 3 rinsing cycles and one washing cycle in less than 28 minutes, including all non-productive periods like water inlet and water outlet periods.

Of course, the limitation to a single washing cycle and the use of a minimum of washing and rinsing liquid is not always a necessary characteristic of the invention. For washing processes during the finishing, bleaching and dyeing of textiles, treatment of already soaking materials could be affected with longer cycles. The procedure may also find application in dry-cleaning operations with appropriate cleaning liquids. Of course, leather, skins, yarns, etc. can be treated as well.

We claim:

1. Procedure for the washing of textiles through a wash and rinse cycle in a tub-type washing machine with a horizontally arranged tub, in which during the washing and rinsing cycles the tub is driven with a rotational velocity at which the centrifugal velocity at the tub case is between 0.4 and 0.95 g, so that the textiles, during the washing and rinsing cycles, are repeatedly lifted up, and then fall in a trajectory path onto the lower portion of the tub and that between washing and rinsing cycles and after the last rinsing cycle they are spun, characterized in that when the machine is loaded, the tub rotates at a rotational velocity at which the centrifugal velocity at the tub case is 0.2–0.6 g, that washing liquid is constantly supplied until all textiles are wetted with an amount of washing liquid equal to between 45 and 100% of the maximum amount that can be absorbed by the textiles, that following the washing cycle the tub is driven at a certain spin speed until a first amount of washing liquid is completely spun out, then spinning is continued until a further amount of liquid is spun out, that during the subsequent rinsing cycle water is led in in the same manner as washing liquid is led in for the washing cycle, and that the tub is driven with the same speed during washing, and that after each subsequent rinsing cycle spinning is done in the same manner as after washing.

2. Procedure according to claim 1 characterized in that the washing liquid and the rinsing water are filled into a suds container in such a way that the textile pieces lying at the bottom of the tub at that moment are on the average immersed less than 30%.

3. Procedure according to claim 1 characterized in that washing liquid and rinsing water are led in through at least one nozzle spraying into the tub either continuously or in intervals, and that the constantly sprayed-in amount is not higher than that which can be largely absorbed by the textiles.

4. Procedure according to claim 1 characterized in that during spinning the tub is driven until about 85% of the liquid is absorbed by the textiles, minus the liquid soaked up by the fibres, is spun out.

5. Procedure according to claim 1 characterized in that after the last rinsing cycle spinning is done in such a way that at least 90% of the water absorbed in the last rinsing cycle, minus the water soaked up by the fibres, is removed.

6. Procedure according to claim 1 characterized in that during loading of the machine the tub is driven for less than 3 minutes.

7. Procedure according to claim 1 characterized in that during washing the tub is driven for no longer than 6 minutes.

8. Procedure according to claim 1 characterized in that during the rinsing cycle the tub is driven for no longer than 4 minutes.

9. Procedure according to claim 1 characterized in that the washing liquid added to the textiles is at least 95% dissolved, and that the washing liquid's differences in concentration amount to less than 10%.

10. Procedure according to claim 9 characterized in that the washing liquid is a saturated detergent solution.

11. Procedure according to claim 1 characterized in that washing liquid and rinsing water are used at temperatures which are the maximum tolerable for each type of textiles.

12. Procedure according to claim 11 characterized in that the temperature of the liquid in the tub is maintained by adding heat energy.

13. Procedure according to claim 1 characterized in that after spinning, except after final dry-spinning, the textiles are pressed away from the tub case by a stream of water directed into the tub from outside through the holes of the tub.

14. Procedure according to claim 1 characterized in that initially 70% to 80% of the liquid is added to the textiles, and the rest is added after an interval of at least 20 seconds.

* * * * *

UNITED STATES PATENT OFFICE

CERTIFICATE OF CORRECTION

Patent No. 4,432,111 Dated February 21, 1984

Inventor(s) ERNST H. HOFFMAN and HANS F. ARENDT

It is certified that error appears in the above-identified patent and that said Letters Patent are hereby corrected as shown below:

In Col. 9, line 36, delete the word "is".

Signed and Sealed this

*Eighth* Day of *May 1984*

[SEAL]

*Attest:*

GERALD J. MOSSINGHOFF

*Attesting Officer*

*Commissioner of Patents and Trademarks*